US006405808B1

(12) United States Patent
Edwards et al.

(10) Patent No.: US 6,405,808 B1
(45) Date of Patent: Jun. 18, 2002

(54) METHOD FOR INCREASING THE EFFICIENCY OF DRILLING A WELLBORE, IMPROVING THE ACCURACY OF ITS BOREHOLE TRAJECTORY AND REDUCING THE CORRESPONDING COMPUTED ELLISE OF UNCERTAINTY

(75) Inventors: John E. Edwards, Aberdeen (GB); John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/539,112

(22) Filed: Mar. 30, 2000

(51) Int. Cl.[7] ..... E21B 47/022
(52) U.S. Cl. ..... 175/45; 175/61
(58) Field of Search ..... 175/40, 45, 61, 175/24, 26, 27

(56) References Cited

U.S. PATENT DOCUMENTS

| | | | | |
|---|---|---|---|---|
| 3,497,958 A | | 3/1970 | Gollwitzer | |
| 4,733,733 A | | 3/1988 | Bradley et al. | |
| 5,220,963 A | * | 6/1993 | Patton | 175/45 |
| 5,341,886 A | | 8/1994 | Patton | |
| 5,410,303 A | | 4/1995 | Comeau et al. | |
| 5,448,227 A | | 9/1995 | Orban et al. | |
| 5,602,541 A | | 2/1997 | Comeau et al. | |
| 5,646,611 A | | 7/1997 | Dailey et al. | |
| RE35,790 E | | 5/1998 | Pustanyk et al. | |
| 5,812,068 A | | 9/1998 | Wisler et al. | |
| 6,088,294 A | * | 7/2000 | Leggett, III et al. | 175/45 |
| 6,179,067 B1 | * | 1/2001 | Brooks | 175/45 |

FOREIGN PATENT DOCUMENTS

| | | |
|---|---|---|
| GB | 2 225 118 | 5/1990 |
| WO | 99/28594 | 6/1999 |

* cited by examiner

*Primary Examiner*—William Neuder
(74) *Attorney, Agent, or Firm*—J. L. Jennie Salazar

(57) ABSTRACT

A well survey process for combining highly accurate well survey data with lower quality survey data in such manner that survey determination of overall borehole trajectory is improved. The inclination and/or azimuth of the wellbore path at each of the wellbore survey stations is acquired with a MWD tool or other survey instrument maintained stationary within the wellbore. Continuous survey measurements, for inclination and/or azimuth are taken during the drilling process and therefore less accurate due to significant drilling noise. Stationary survey measurement is more accurate but infrequently sampled, while continuous inclination and/or azimuth measurement is less accurate but more frequently sampled. The objective is to augment a conventional minimum radius of curvature approximation of the wellbore trajectory between the survey stations with whatever reliable information can be extracted from the continuous inclination and/or azimuth measurements. The continuous position augmentation of the conventional minimum radius of curvature approximation minimizes wellbore trajectory errors between survey stations and thus enhances the accuracy of the calculated spatial position or trajectory of the wellbore being drilled.

30 Claims, 2 Drawing Sheets

METHOD FOR INCREASING THE EFFICIENCY OF DRILLING A WELLBORE, IMPROVING THE ACCURACY OF ITS BOREHOLE TRAJECTORY AND REDUCING THE CORRESPONDING COMPUTED ELLISE OF UNCERTAINTY

BACKGROUND OF THE INVENTION

1. Field of the Invention

The present relates generally to methods and apparatus for improving the efficiency of the drilling process and also conducting surveys of drilled wells, particularly directional wells having wellbores that transition from vertical to inclined to horizontal orientation for intersecting a desired subsurface anomoly or target. More specifically, the present invention is directed to a method for increasing the efficiency of the drilling operation by minimizing the number of high accuracy stationary measurements by integrating or augmenting that measurement sequence with an additional sequence of lower accuracy measurements that can be made without having to suspend the drilling operation. A particular embodiment of this invention is a method for developing a well survey wherein continuous inclination data, typically achieved by a measuring while drilling ("MWD") tool, is integrated with or used to augment the minimum radius of curvature approximation of the trajectory shape between conventional survey points taken along a wellbore trajectory to define individual arcs and tangents in the trajectory and thereby improve the accuracy of the wellbore's position.

2. Description of the Related Art

In drilling a directional well, it is common to use a bottom hole drilling assembly (BHA) that is attached to a drill collar as part of the drill string. This BHA typically includes, in descending order, a drilling motor assembly, a drive shaft system including a bit box and a drill bit. In addition to the motor, the drilling motor assembly may include a bent housing assembly which has a small bend angle in the lower portion of the BHA. This bend angle causes the borehole being drilled to curve and gradually establish a new borehole inclination and/or azimuth. During the drilling of a borehole, if the drill string is not rotated, but merely slides downward as the drill bit is being driven only by the motor, the inclination and/or the azimuth of the borehole will gradually change, in other words, curve, due to the bend angle, thus forming a curved wellbore section. Depending upon the tool face angle, that is, the angle at which the drill bit is pointing relative to the high side of the borehole, the borehole can be made to curve at a given azimuth and inclination. If however, the rotation of the drill string is superimposed over that of the output shaft of the motor, the bend point will simply travel around the axis of the borehole so that the bit normally will drill straight ahead at whatever inclination and azimuth have been previously established, thus forming a straight wellbore section. The type of drilling motor that is provided with a bent housing is normally referred to as a steerable drilling system. When drilling with a steerable drilling system of this nature, various combinations of sliding and rotating drilling procedures can be used to control the borehole trajectory in a manner such that eventually the drilling of a borehole will proceed to a targeted formation. Stabilizers, a bent sub, and a kick pad also can be used to control the angle build rate in sliding drilling, or to ensure the stability of the wellbore trajectory in the rotating mode. Thus, when the drill string is not being rotated and the drill bit is being rotated by the drilling motor in a steerable or directional drilling system, the wellbore segment being drilled will be of curved geometry. Likewise, when the drill string is being rotated and the drilling motor is also being operated, the resulting wellbore section being drilled will be substantially straight.

During well drilling, to confirm the spatial position of the wellbore being drilled as it progresses through the formation, it is necessary to conduct periodic well surveys, either using a well survey instrument or using the various sensors of a measuring while drilling (MWD) tool that is incorporated within the well drilling string. These periodic well surveys establish survey stations at selected intervals along the length of the wellbore. Typically, between survey stations the wellbore will be defined by a number of straight wellbore sections or tangents which result from drilling with the drill motor and simultaneously rotating the drill string and a number of curved wellbore sections or arcs which result from drilling only with the drill motor without rotating the drill string, so that the drill string merely slides along the curved wellbore section being drilled. While the survey stations are typically located at substantially equally spaced locations along the wellbore, typically determined by the lengths of the drill pipe sections or the length of the stands of drill pipe, the lengths of the arcs and tangents will vary according to bent motor orientation during drilling. It is typical to compute the trajectory of a wellbore by using a minimum radius of curvature algorithm which assumes that the geometry of a wellbore between survey stations lies along a smoothly curved arc. Well surveys being calculated from the data and the survey points can have significant error because the actual geometry of the drilled wellbore in most cases will not lie along a curve of fixed curvature but rather will consist of a plurality of arcs and tangents arranged end to end and having a bend angle at the juncture of the arcs and tangents. Thus, the spatial position of the wellbore at any given depth can be sufficiently in error that an intended target can be missed.

The same general wellbore geometry is established, as indicated above, when rotary steerable drilling systems are employed for well drilling activities. A rotary steerable drilling tool typically includes a drill collar that is rotated by a drill string and supports a bit shaft to which a drill bit is fixed. The bit shaft is angularly adjusted relative to the drill collar about a pivot mount within the drill collar. As rotary drilling progresses, the angular position of the bit shaft and thus the drill bit is adjusted, in other words, steered by steering control signals communicated from the surface or by on-board sensor responsive steering signals to define straight borehole sections or curved borehole sections having periodically controlled inclination and azimuth to progress the wellbore toward an intended subsurface target. The result of this steerable drilling with a rotary steerable drilling tool is that the wellbore being drilled will be defined by a series of arcs and tangents in the same manner as discussed above. For accurately determining the spatial position of the wellbore at any desired location between the survey points that are achieved at intervals when drilling is discontinued, the trajectory shape of the wellbore between the survey points is desired.

Historically, well surveys were, and in many cases are conducted by running into a wellbore a well survey sonde having a housing that is selectively positioned by cable equipment. The cable equipment typically incorporates electrical conductors for conducting various position signals from on-board sensors of the survey tool to surface equipment for receiving and processing the signals. The survey instrument will typically incorporate one or more inclinometers and an orthogonal triad of accelerometers for measuring the angle of the local vertical with respect to the sonde. Since the sonde handling cable does not control rotational positioning of the sonde, it is necessary that the surveying instrument have the capability for measuring probe orientation to provide a reference for the inclinometer measurements and thus enable measurement of the azimuth of the borehole at the survey point or station. Sonde orientation may be measured with gyroscopes or magnetometers which may be utilized independently or in conjunction with other position sensing systems. When a borehole is surveyed using a sonde or survey instrument of this nature the result is typically a series of survey points or stations at fairly widely spaced intervals along the wellbore. The survey points, which are accurate from the standpoint of inclination and azimuth, are recorded and are then processed by the minimum radius of curvature algorithm, or any other similar algorithm to approximate the geometry, inclination and azimuth of the wellbore between the survey points. Though these widely spaced survey points can be utilized to fairly closely approximate a curved wellbore substantially incorporating the survey points, the true geometry of the wellbore cannot be accurately determined in this manner. However, for accurate determination of spatial position of the wellbore at any desired location along its length, it is highly desirable to have the ability of accurately measuring the arcs and tangents and correlating such measurements with the survey station measurements.

The current method of computing a directional wellbore's spatial position is to integrate from the surface or from a known point along a well path which is defined by a series of survey points. These survey points give the inclination and azimuth of the wellpath at specific depths, and are indexed in measured depth. The minimum radius of curvature algorithm is used to interpolate between the survey points. However if the directional well is drilled with a bent motor, the real trajectory of the wellbore will consist of a series of arcs, curved wellbore sections, and tangents, straight wellbore sections, as the drilling motor is slid or rotated. If the along hole length of the slide or tangent sections of the wellbore is less than the survey interval, then the minimum radius of curvature algorithm models the trajectory as one single continuous are with a constant radius of curvature, overestimating the true vertical depth of the well. It is desirable therefore to provide a well survey system which takes into account accurate well survey signals that are acquired at the widely spaced survey stations and which also take into account substantially continuous inclination measurement data that is acquired during drilling. A continuous inclination measurement can be used to define the individual arcs and tangents in the borehole trajectory between survey stations, thereby improving the accuracy of the integration, and therefore the accuracy of the wellbore's spatial position.

In addition to measuring the well-bore trajectory, it is usually convenient and often necessary to make additional measurements from within the well-bore while it is being drilled. As with the well-bore surveys, these additional measurements can generally be made to a higher accuracy or resolution when the tool is stationary. For example, formation pressure measurements can be made from sensors positioned on the drillpipe if such sensors can be extended into the formation as probes or by inflating packers to isolate such sensors from the hydrostatic pressure above and below the tool. This operation requires stopping drilling. Approximate measurements or inferences of pressure, however, can be made while drilling. For example, within a particular sedimentary basin it is possible to derive empirical relationships between formation resistivity, porosity and formation pressure. Measurements of resistivity and porosity can be made without suspending the drilling operation, but inferences of formation pressure from such measurements are inherently less accurate than a direct measurement and may commonly also suffer from a bias offset or gain. It is desirable therefore to provide a combined measurement system which takes into account the well measurements acquired at widely spaced intervals and which also takes into account the well measurements that are obtained from a substantially continuous measurement made while drilling.

SUMMARY OF THE INVENTION

It is a principal feature of the present invention to provide a novel method for increasing the efficiency of the drilling process by providing a method which accurately measures properties of the formation, the wellbore trajectory or the drilling processes itself while at the same time minimizing any requirement to suspend that drilling process.

It is also a principal feature of the present invention to provide a novel method for accurately measuring the spatial position of a wellbore at any position or depth along the wellbore to more efficiently provide for steering of a wellbore to an intended subsurface target;

It is another feature of the present invention to provide a novel method in which complete and highly accurate well surveys can be taken less frequently by adding a larger number of substantially continuous measurements albeit of lower accuracy.

It is also a feature of the present invention to provide a novel method, providing a process for combining highly accurate survey data with lower quality survey data in such a way that the accuracy of the overall borehole trajectory is improved.

It is another feature of the present invention to provide a novel method for measuring curved and tangent segments of a wellbore by continuous inclination measurements during drilling and by augmenting the minimum radius of curvature calculation between spaced survey points along the wellbore with the continuous inclination measurements to thus provide for significantly enhanced accuracy of the calculated spatial position of the wellbore at any location along the length thereof.

It is also a feature of the present invention to provide a novel method for wellbore surveying wherein substantially continuous inclination measurements of the wellbore are acquired by a MWD tool during drilling, periodic survey points are established along the wellbore with the MWD tool or other measurement tool static within the wellbore and then integrating the survey point measurements with the substantially continuous inclination measurements to achieve highly accurate measurement of the spatial position of the wellbore.

It is an even further feature of the present invention to provide a novel method for wellbore surveying wherein a substantially continuous inclination log is established between survey points and a gain and offset are applied to each section, forcing a match between the continuous inclination measurements and the station inclination measurements at the endpoints of each section and confirming agreement at the endpoints.

Briefly, the invention provides a method that includes the steps of taking discrete measurements of a well or formation parameter having a first accuracy when drilling is substantially suspended, and taking substantially continuous measurements of the well or formation parameter having a second accuracy during a drilling operation. The second accuracy has a reduced accuracy compared to the first accuracy. The measurements having the first and second accuracies are then combined, whereby the well may be efficiently drilled.

In a particular embodiment, the invention further contemplates the step of applying the combined measurements to other sets of discrete measurements taken while drilling is substantially suspended.

The invention further provides a method of drilling of a well which includes the steps of taking discrete measurements of a well parameter with a first instrument when drilling is substantially suspended, taking substantially continuous measurements of the well parameter with a second instrument during drilling, the second instrument having reduced accuracy compared to the first instrument, and combining the measurements from the first and second instruments to maximize the accuracy of the measurements taken with the first instrument. In this manner, the well may be efficiently drilled and the utility of both sets of measurements is maximized.

For example, efficient drilling may take advantage of long stands of drillpipe is often impeded by the need to take a full survey every 30 feet of drillpipe. The invention described herein details a process by which complete and highly accurate measurements can be taken less frequently by adding a larger number of substantially continuous measurements albeit of lower accuracy.

In a particular embodiment, the method can be used with continuous inclination and/or azimuthal data determined between survey stations, whereby the survey station measurements are augmented with the continuous inclination measurements to improve the accuracy of the calculated results of a minimum radius of curvature computation or any similar algorithm. The particular embodiment is therefore a process to combine highly accurate survey data with lower quality survey data in such manner that the accuracy of the overall borehole trajectory is improved.

The inclination and azimuth at the survey stations is acquired with the MWD tool of the drilling system stationary so that drilling noise will not be present during acquisition of the survey points. Continuous survey measurements are acquired during the drilling process, therefore drilling noise is present. Survey points established with the drilling system stationary are more accurate but infrequently sampled because drilling is stopped to facilitate the survey. Continuous surveying is less accurate, because of the presence of drilling noise, but is more frequently sampled because it can be done while drilling is in progress. The objective of the particular embodiment is to augment the minimum radius of curvature approximation of the trajectory shape between the survey stations with whatever reliable information can be extracted from the continuous inclination measurements. Additionally, from the standpoint of signal processing, the continuous inclination measurements can be electronically filtered to minimize the influence of drilling noise and thereby enhance the vitality of the resulting measurements.

BRIEF DESCRIPTION OF THE DRAWINGS

The manner in which the above recited features, advantages and objects of the present invention are attained can be understood in detail by reference to the preferred embodiment thereof which is illustrated in the appended drawings, which drawings are incorporated as a part hereof.

Even though this embodiment pertains to the use of the invention for the purpose of increasing drilling efficiency and accuracy by means of an augmentation of stationary survey measurements with continuous survey measurements, this description is not intended to be construed in this limiting sense. As is apparent to those skilled in the art, the invention is equally applicable to other measurements made during the drilling process, such as measurements of formation properties and measurements of the drilling process itself.

Figure 1:
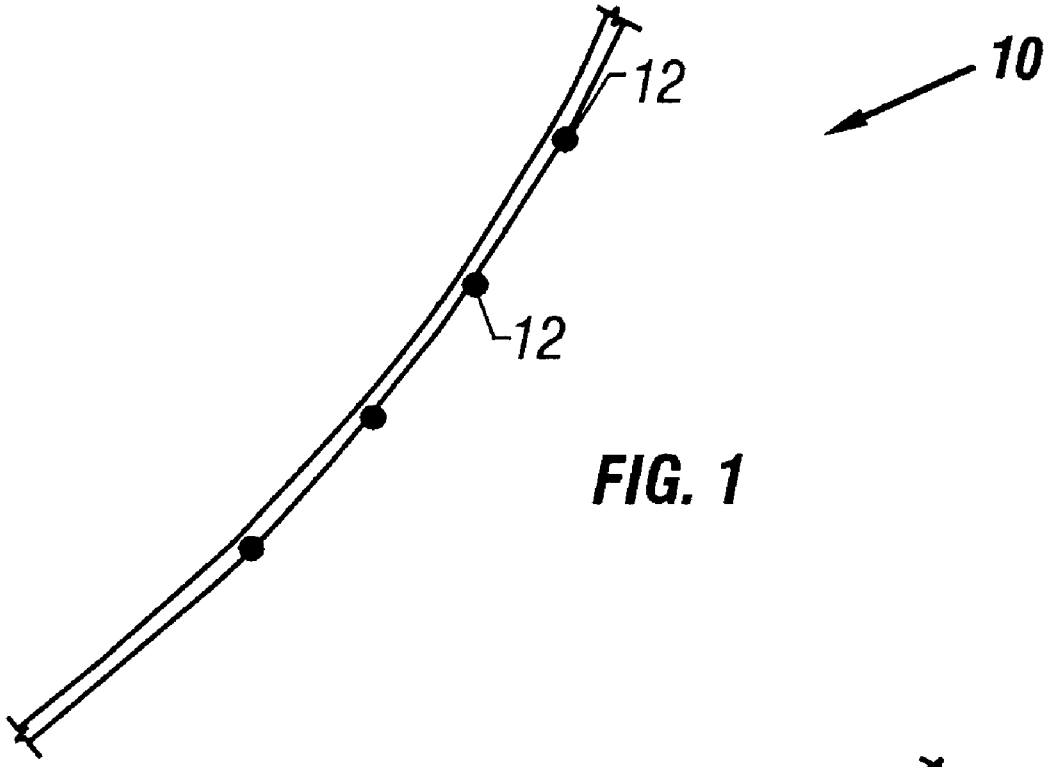

It is also to be noted that the appended drawings illustrate only a typical embodiment of this invention and are therefore not to be considered limiting of its scope, for the invention may admit to other equally effective embodiments.

Figure 2:
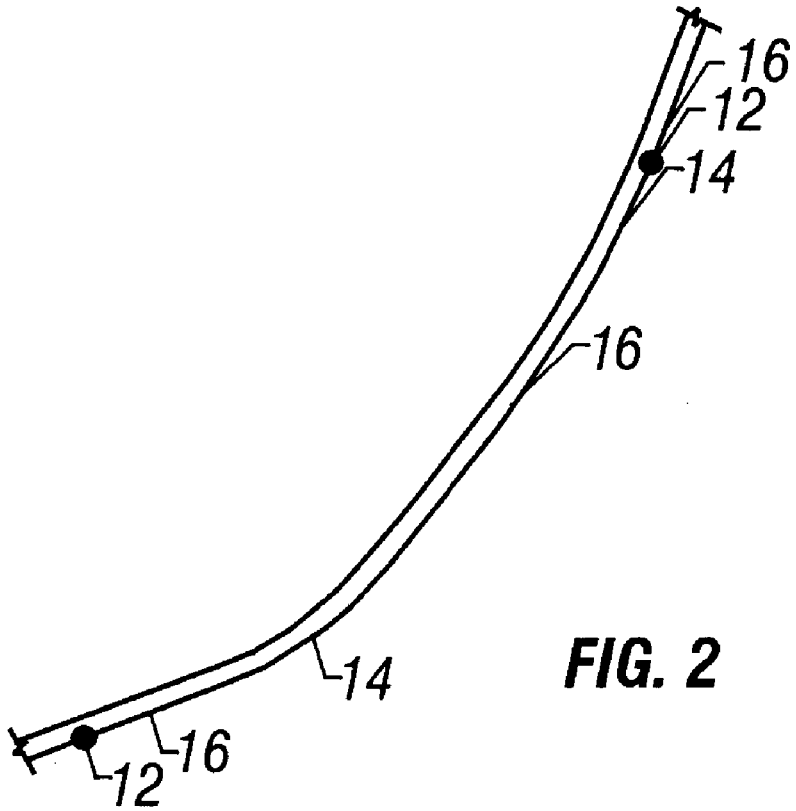
Figure 3:
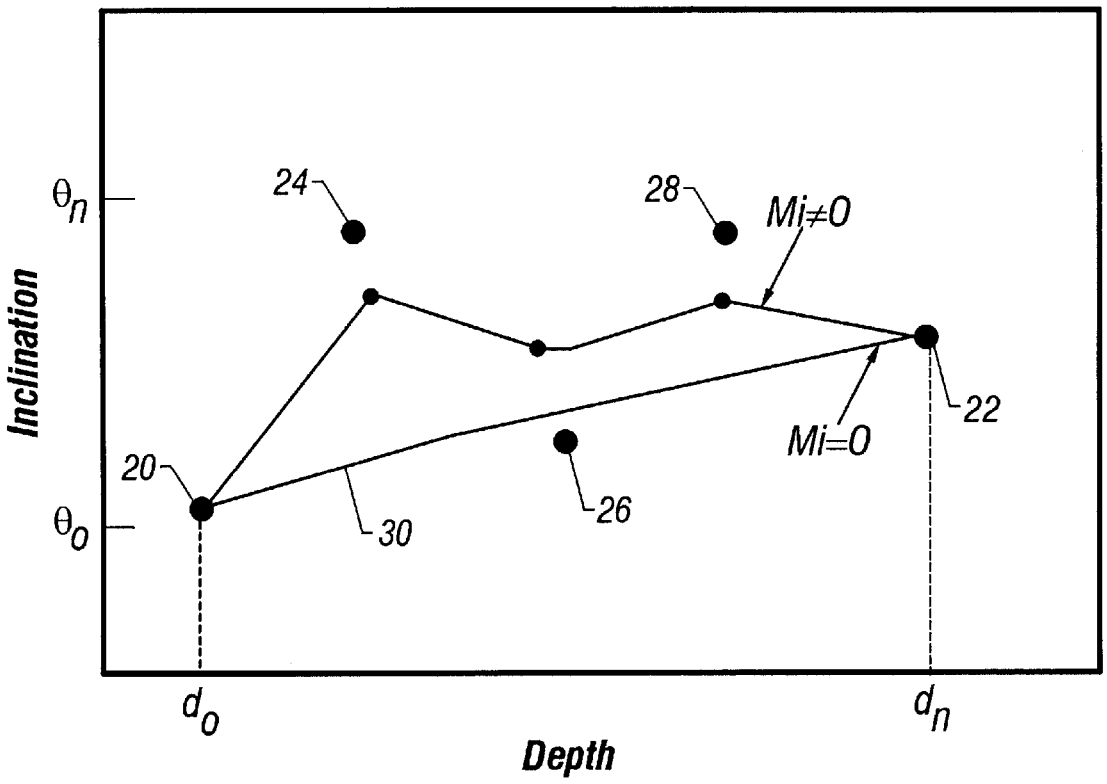

In the Drawings:

FIG. 1 is a diagrammatic illustration of a wellbore path having multiple survey points or stations located at selected well depths and showing the general trajectory shape of the wellbore path;

FIG. 2 is a diagrammatic illustration of an enlarged section of the wellbore path of FIG. 1 and showing arcs and tangents in the wellbore trajectory between each of the survey points or stations which are identified by substantially continuous inclination data; and FIG. 3 is a diagrammatic illustration of the solution combining continuous inclination data with full survey data.

DETAILED DESCRIPTION OF PREFERRED EMBODIMENTS

Referring now to the drawings and first to FIG. 1, a diagrammatic illustration of a wellbore path is illustrated generally at 10 having multiple survey points or stations 12 taken at intervals along the wellbore path or trajectory. For example, the survey point intervals may be spaced in the order of 90 feet, since modem day well drilling apparatus employs top drive systems which permit drilling in stands of 90 feet, comprising three connected 30 foot sections of drill pipe. Even though MWD systems are presently employed for wellbore surveys, drilling activity must be stopped so that the MWD tool will be static during the survey and drilling noise will not be present to degrade the survey. For the reason that drilling activity must be stopped to facilitate the survey, wellbore surveys are typically conducted at the time another section of drill pipe is connected into the drill string. If the drilling system is designed for periodic addition of individual drill stem sections, with are typically 30 feet in length, then periodic static surveys can be taken having substantially 30 foot intervals. If the drilling system employs a top-drive system, as is typically the case with modem day well drilling equipment, then drill stem sections or stands, each having three interconnected 30 foot drill stem sections will be utilized. In this case, drilling can be continuous until a 90 foot stand has entered the wellbore being drilled. In such a case, however, a stationary survey will have to be done at 90 foot intervals.

As shown by the enlarged diagrammatic illustration of FIG. 2, the wellbore path or trajectory between the survey points or stations 12 typically comprises a number of arcuate sections 14 and a number of tangent sections 16. These tangent sections and arcuate sections will typically be of differing length due to the steering corrections that are required to steer the wellbore along an intended trajectory. As mentioned above, when the housing of the drilling motor is rotated by the drill stem during drilling, the result is the drilling of a straight wellbore section along the inclination and azimuth that is established by the drilling motor and drill bit. This straight wellbore section is also identified as a tangent, because of its tangential relation with the adjacent arcuate wellbore section. When the housing of the drilling motor is not being rotated and the drill bit is being rotated by the drilling motor, the result will be an arcuate wellbore section determined by the angular relation of the bit shaft and drill bit with the housing of the drilling motor. During drilling of this character, the drilling motor housing and motor will move along the wellbore trajectory without being rotated. This is typically referred to in the industry as a "slide" because the bent drill motor drill string is merely sliding down the wellbore as the drill bit advances. Since there can be many arcuate sections and tangent sections in the 90 foot interval between survey points or stations, and since the relation of these arcuate sections and tangent sections significantly influences the accuracy of the wellbore trajectory, it is considered desirable that a survey system be employed which takes them into account. Heretofore, no wellbore surveying system has been developed which identifies the individual curved sections and tangent sections of a wellbore and their respective lengths between survey stations. Currently, a conventional minimum radius of curvature algorithm is utilized to process station survey data and thus approximate a curved wellbore section between the survey stations. Actually, however, a wellbore being steered during its drilling will seldom define a smooth curve between the survey stations, especially when the survey stations are widely spaced, by 90 feet, for example. Since the wellbore path between survey stations is actually defined by multiple interconnected curved sections and tangent sections of varying length, there can be considerable difference in calculated spatial position as compared with actual spatial position of the wellbore. If the wellbore is being steered during drilling toward a rather small subsurface anomaly or target, a miscalculation of the actual spatial position, typically depth, can result in the target being missed. In this case, it will typically be necessary to drill an offset from a particular position to the target, an expensive and time consuming problem, or to simply abandon the wellbore trajectory to this particular target.

When the conventional minimum radius of curvature algorithm is employed for approximation of the trajectory shape of the wellbore between the widely spaced survey points, the multiple arc and tangent wellbore sections are not specifically considered. Consequently, the minimum radius of curvature can be significantly different as compared with the actual configuration of the wellbore path. In a deviated wellbore having significant general inclination, the plot of the spatial actual measurement can vary from the actual trajectory of the wellbore being drilled, the result being that the drilling system can entirely miss an intended target.

One approach is to divide the continuous inclination data log into sections between each survey, and apply a gain and offset to each section forcing a match between the continuous and station inclination at the endpoints of each section where they should agree. The calibrated continuous inclination is then examined to locate the measured depths of the beginning and end of each slide. These depths are used to augment the original surveys. The inclination at these interpolated surveys is read from the calibrated continuous inclination, and the azimuth is interpolated from the adjacent real surveys. The minimum radius of curvature algorithm will still be used between the real and augmented surveys, but, because the augmented surveys will isolate each arc and tangent in the trajectory, a wellbore approximation is provided that will no longer introduce a systematic error.

As indicated above, the present invention is applicable when any drilling equipment is utilized in a manner generating a series of arcs and tangents to form the wellbore geometry or trajectory shape between conventional widely spaced survey points. Thus, the present invention is applicable when the well is being drilled with a drill bit that is rotated by a drill motor that is connected to a non-rotary drill string. The invention is also applicable when the wellbore is being drilled by a rotary steerable drilling tool that is driven by a rotary drill string, with steering being accomplished by selectively adjusting the angular position of a bit shaft relative to a drill collar.

Another more automated approach finds the best compromise between a minimum radius of curvature interpolation between the survey stations and the absolute use of the continuous inclination by minimizing the sum of the total curvature and departure from the measured continuous inclination.

With regard to augmenting the survey calculations with continuous inclination measurements, the following interesting points should be considered:

(i) (Regardless of continuous inclination) The historical method of minimizing the radius of curvature translates to minimizing the integral of the square of the curvature. More 20 generally, it can be shown that if one minimizes the integral of the curvature, raised to the power of $\alpha$, then: for $\alpha>1$ the answer will be correct; for $\alpha=1$ the solution will be non-unique; and for $\alpha<1$ the answer will not be correct. In this last case, the minimum would correspond to a physically unrealistic wellbore having a lot of straight sections interspersed by bends done at high dogleg, in other words, at a significant bend angle.

(ii) To augment survey station measurements with continuous inclination measurements it is therefore considered appropriate to add the square of the difference between predicted inclination and measured inclination. In particular, this results in a well-posed quadratic minimization problem. Because different measurement sensors can be affected to varying degrees by instrumentation noise, different weightings can be applied to each measurement.

(iii) This minimization problem separates into a "continuous" problem (between continuous inclination measurements) and a "discrete" problem (at the inclination measurements). The continuous problem can be solved analytically. Consequently, the discrete problem can be solved analytically as well.

(iv) The optimal result is that the inclination is a piecewise linear measurement with a solution given by inverting a tridiagonal matrix of order N where N is the number of continuous inclination points between survey points. This can be solved in order-N complexity, so there is little performance penalty in performing such a computation on a well-site acquisition system.

(v) The corresponding changes in total vertical depth ("TVD") and drift take on a straightforward form.

(vi) Though the present invention has been discussed herein particularly as it relates to continuous inclination measurements, it should be borne in mind that the same method will function quite adequately for adding continuous azimuth measurements.

A description of borehole trajectory in 3D space consists of a description of TVD, north-south drift and east-west drift as a function of the measured depth in the borehole. Such values are typically obtained by measuring the inclination and/or azimuth at points along the trajectory and then interpolating using a standard formulation such as choosing the circle of maximum radius between the two points. The method according to the present invention combines a multiplicity of such measurements each with different measurement accuracy. For example, a survey tool developed by Schlumberger, and identified by the trademark PowerPulse™, provides highly accurate 6-axis measurements of the borehole trajectory at every stationary survey. In between such surveys, every few seconds this survey tool can transmit so called continuous-inclination surveys which have an accuracy/precision which is less than that of the stationary surveys. Continuous azimuthal surveys can also be transmitted and these are viewed as even less accurate than the continuous inclination surveys. Inclination can even be provided by a separate sensor, such as from well survey tools of Schlumberger, including the GeoSteering™ tool, the RAB™ tool or the new AIM™ tool for at-the-bit inclination measurement.

The present invention may encompass an infinite space of possible continuous curves (P(t): t $\epsilon$[0,1]) to find that particular curve which minimizes a functional of the form $$\int \kappa(t)^{\alpha} dt + \sum_i m_i(\hat{\theta}_i)(\theta_i - \hat{\theta}_i)^2 + \sum_i n_i(\hat{\phi}_i)(\phi_i - \hat{\phi}_i)^2$$

where: $\kappa(t)$ is the curvature of the wellbore trajectory P; $\alpha$ is a parameter greater than 1; $\theta_i$ and $\phi_i$ are the continuous inclination and azimuthal measurements; $\theta_i$ and $\phi_i$ are the computed inclination and azimuth of the curve P at a point (or time) $t_i$; and $m_i$ and $n_i$ are weighting parameters that increase according to the accuracy or "weight" one can establish to a given measurement. Techniques to estimate $m_i$ and $n_i$ from data are well known to those skilled in the art. Note that these have been taken as functions of $\hat{\theta}_i$ and $\hat{\phi}_i$. For example, in some situations the error on a single axis continuous inclination measurement might decrease as a function of borehole inclination in which case one could choose $$m_i(\hat{\theta}_i)=m \tan(\hat{\theta}_i)$$

where m is a constant weighting dependent upon sensor electronics.

An alternative would be to have $m_i$ and $n_i$ as functions of $\theta_i$ and $\phi$, if a non-linear minimization routine was preferred. In some cases, the raw continuous inclination and/or azimuth will have a bias or offset that can be estimated, in which case $\hat{\theta}_i$ and $\hat{\phi}_i$ represent the values after adjustment for bias and offset.

Surprisingly, this minimization problem can be solved analytically, which means that a practical algorithm can be written instead of just an abstract symbolic representation. Equally surprising, the minimization is essentially independent of $\alpha$. Any a value greater than 1 will result in the physically appropriate answer. An $\alpha$ value less than 1 would result in an estimated borehole with maximized doglegs separated by long straight sections. A value of $\alpha$=1 does not give a unique minimum. As a consequence, one can suppose the value of $\alpha$=2 for subsequent calculations which means that one can take advantage of standard quadratic programming methods.

For simplicity, a user of the present invention will give the solution for the case of only having an input (for example, PowerPuls™) survey at t=0 and t=1. In other words, the user is given P'(0) and P'(1) and assumes that only additional inclination measurements are of concern. The user can suppose that the length of borehole between t=0 and t=1 is L and choose |P'(t)|=which simplifies the mathematics (but does not restrict the scope of the invention). In particular, this simplification means that the general expressions for tangent vector, normal vector and curvature:

$$T(t)=P'(t)/|P'(t)|,\ N(t)=T'(t)/|T(t)| \text{ and } \kappa(t)=|T(t)|/|P'(t)|$$

simplify to T(t)=P'(t) and $\kappa(t)=|P''(t)|$.

If one assumes for the moment that the curve lies in a linear plane with instantaneous inclination $\theta$ then:

$$P'(t)=L(\cos\theta\hat{x}+\sin\theta\hat{y})$$

so that P''(t)=$\theta$'(t) and our functional to be minimized becomes:

$$\int\theta(t)^2dt+\Sigma m_i(\theta_i-\hat{\theta}_i)^2.$$

Suppose that $\theta_i$ are the actual inclination values of P(t) corresponding to the measured values $\hat{\theta}_i$ (in other words, the real inclination of the borehole at each point) then the minimum of each component of the integral between $t_i$, $t_{i+1}$, etc, does not depend upon the $\theta_i$, only the $\hat{\theta}_i$ This minimum is known to be just a section of a circle with inclination given by the $\hat{\theta}_i$. In other words, the inventors have proven that the minimum curve is a sequence of arcs of curves and straight lines. The minimum can be determined exactly and requires minimizing:

$$\Sigma(\theta_i-\theta_{i+1})^2+\Sigma m_i(\theta_i-\hat{\theta}_i)^2$$

with $\theta_o$ and $\theta_n$ being the full survey data at t=0 and t=1, respectively. This minimum follows by differentiating with respect to $\theta_i$ The terms in which $\theta_i$ contributes are:

$$(\theta_{i-1}-\theta_i)^2+(\theta_i-\theta_{i+1})^2+mi(\theta_i-\hat{\theta}_i)^2$$

so one can set the derivative to zero to give an explicit formula for $\theta_i$, namely:

$$\theta_i = \frac{\theta_{i+1} + \theta_{i-1} + m_i\hat{\theta}_i}{2 + m_i}$$

with $\theta_0$=P'(0) and $\theta_n$=P'(1). This is a tridiagonal system that can be solved easily (with a computational time proportional to the number of inclination measurements). Recall that $m_i$ is a weighting function which varies with the estimate $\theta_i$;. For example, if $m_i$ is taken very large then $\theta_i \approx \hat{\theta}_i$, in other words, the computed trajectory will be the minimum radius of curvature going through all of the continuous survey points, whereas if $m_i$ is taken as close to zero (as would be the case in near vertical wells), then the computed trajectory is the traditional radius of curvature going through P'(0) and P'(1) and ignoring the continuous inclination, as shown in FIG. 3.

Referring to FIG. 3, the graphical representation of inclination versus depth illustrates full survey data points 20 and 22 and continuous inclination data points 24, 26 and 28. This graphically illustrated solution illustrates combining continuous inclination data with zero weighting ($m_i$=0) and non-zero weighting. For zero weighting, the computed inclination is a straight line 30 joining the full survey data points 20 and 22. For non-zero weighting, the solution is a piecewise linear curve between the values $\theta_i$.

The extension to a full 3-D problem utilizing both continuous azimuth and continuous inclination follows similarly.

As written, the algorithm for $\theta_i$ supposes a known value of P'(0) and P'(1), in other words, it interpolates the curve between the last two full survey points. A modification of the algorithm for use in real-time would allow projection ahead so that P'(1) is a value estimated from the data already transmitted to the surface.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method of drilling of a well, comprising the steps of:

taking discrete measurements of a well or formation parameter having a first accuracy when drilling is substantially suspended;

taking substantially continuous measurements of the well or formation parameter having a second accuracy during a drilling operation, the second accuracy being of a reduced accuracy compared to the first accuracy;

drilling the well based on the measurements having the first and second accuracies, whereby the number of discrete measurements taken is reduced and the efficiency of the drilling operation may be increased.

2. A method of drilling of a well, comprising the steps of:

drilling a well;

taking discrete measurements of a well or formation parameter with a first instrument when drilling is substantially suspended;

taking substantially continuous measurements of the well or formation parameter with a second instrument during drilling, the second instrument having reduced accuracy compared to the first instrument; and altering the drilling process based on the measurements from the first and second instruments whereby the well may be efficiently drilled.

3. A method for increasing the efficiency of the drilling of a well with well drilling equipment comprising:

taking a first measurement of at least one well parameter while drilling is substantially suspended;

taking additional measurements of said at least one well parameter while drilling is substantially continuous;

augmenting said first measurement with said additional measurements in a manner increasing the efficiency of the drilling process by minimizing the frequency with which said first measurements are required without decrease in the overall accuracy; and drilling the well using the augmented measurements.

4. The method of claim 3, wherein said taking a first measurement comprises:

taking high accuracy substantially stationary multi-axis surveys of the wellbore.

5. The method of claim 4, wherein said taking additional measurements of said at least one well parameter comprising:

taking substantially continuous measurements of inclination.

6. The method of claim 4, wherein said taking additional measurements of said at least one well parameter comprising:

taking substantially continuous measurements of azimuth.

7. The method of claim 4, wherein said taking additional measurements of said at least one well parameter comprising:

taking substantially continuous measurements of inclination and azimuth.

8. A method for conducting a well survey for a well being drilled with well drilling equipment, comprising:

(a) taking full surveys with the well drilling equipment static within the wellbore being drilled and achieving full survey data;

(b) taking continuous surveys with the well drilling equipment in operation within the wellbore being drilled and achieving continuous survey data; and (c) combining said full survey data and said continuous survey data to accurately determine wellbore trajectory.

9. The method of claim 8, comprising:

(a) taking said full surveys at desired intervals of depth; and (b) taking said continuous surveys between said desired intervals of depth.

10. The method of claim 8, comprising:

taking a multitude of continuous surveys between adjacent fall surveys.

11. The method of claim 8, comprising:

said continuous surveys being continuous inclination surveys.

12. The method of claim 8, comprising:

said continuous surveys being continuous azimuthal surveys.

13. The method of claim 8, comprising:

said combining comprising ranging over an infinite space of possible continuous curves to identify that particular curve, P, which minimizes a functional of the form $$\int \kappa(t)^{\alpha}\,dt + \sum_i m_i(\hat{\theta}_i)(\theta_i - \hat{\theta}_i)^2 + \sum_i n_i(\hat{\phi}_i, \phi_i)(\phi_i - \hat{\phi}_i)^2$$

where $\kappa(t)$ is the curvature of the wellbore trajectory P, $\alpha$ is a parameter greater than 1, $\theta_i$ and $\phi_i$ are the continuous inclination and azimuth of P, $\kappa_i$ and $\phi_i$ the measured continuous inclination and azimuth, and $m_i$; and $n_i$ are suitably chosen weighting functions.

14. A method for developing a well survey for a directional well having a well path, comprising:

(a) obtaining substantially continuous position measurements along the wellbore path of the well during drilling of the wellbore;

(b) establishing a series of survey points along the wellbore path, said survey points each providing measured inclination and azimuth of the wellbore path at specific depths;

(c) conducting a minimum radius of curvature approximation of the trajectory shape of said wellbore path; and (d) augmenting said minimum radius of curvature approximation with said continuous position measurements to identify wellbore trajectory and geometry between survey points.

15. The method of claim 14, comprising:

(a) said substantially continuous position measurements being substantially continuous inclination measurements acquired during drilling; and (b) said augmenting said minimum radius of curvature approximation comprising correlating said substantially continuous inclination measurements with said minimum radius of curvature approximation.

16. The method of claim 14, comprising:

(a) said substantially continuous position measurements being substantially continuous azimuth measurements acquired during drilling; and (b) said augmenting said minimum radius of curvature approximation comprising correlating said substantially continuous azimuth measurements with said minimum radius of curvature approximation.

17. The method of claim 14, comprising:

(a) said obtaining continuous position measurements being accomplished with survey equipment during drilling; and (b) said establishing a series of survey points being accomplished with said survey equipment static at the depth of each survey point.

18. The method of claim 14, comprising:

said conducting a minimum radius of curvature approximation of the trajectory shape of said wellbore path and said augmenting said minimum radius of curvature approximation with said continuous inclination measurements being accomplished substantially simultaneously.

19. The method of claim 14, comprising:

said augmenting said minimum radius of curvature approximation being accomplished by minimizing the integral of the square of the curvature.

20. The method of claim 14, comprising:

said augmenting said minimum radius of curvature approximation being accomplished by adding to said minimum radius of curvature approximation the square of the difference between predicted and measured position.

21. A method for developing a well survey for a directional well having a well path, comprising:

(a) obtaining substantially continuous position measurements along the wellbore path of the well during drilling of the wellbore;

(b) with a survey tool substantially static within the wellbore for each measurement, measuring a series of survey points along the wellbore path, said survey points each providing measured inclination and azimuth of the wellbore path at survey point depths;

(c) conducting a minimum radius of curvature approximation of the trajectory shape of said wellbore path; and (d) during said conducting step, augmenting said minimum radius of curvature approximation with said continuous position measurements to identify specific wellbore trajectory and geometry between survey points.

22. The method of claim 21, comprising:

(a) said substantially continuous position measurements being substantially continuous inclination measurements acquired during drilling; and (b) said augmenting said minimum radius of curvature approximation comprising correlating said substantially continuous inclination measurements with said survey point measurements and employing said correlated measurements in said minimum radius of curvature approximation.

23. The method of claim 21, comprising:

(a) said substantially continuous position measurements being substantially continuous azimuth measurements acquired during drilling; and (b) said augmenting said minimum radius of curvature approximation comprising correlating said substantially continuous azimuth measurements with said survey point measurements and conducting said minimum radius of curvature approximation by employing the correlated substantially continuous and static azimuth measurements.

24. The method of claim 21, comprising:

(a) said substantially continuous position measurements being substantially continuous azimuth measurements and substantially continuous inclination measured acquired during drilling; and (b) said augmenting said minimum radius of curvature approximation comprising correlating said substantially continuous azimuth measurements and said substantially continuous inclination measurements with said survey point measurements and conducting said minimum radius of curvature approximation by employing the correlated substantially continuous and static azimuth and inclination measurements.

25. The method of claim 21, comprising:

(a) said obtaining continuous position measurements being accomplished with survey equipment during drilling; and (b) said establishing a series of survey points being accomplished with said survey equipment static at the depth of each survey point.

26. The method of claim 21, comprising:

said conducting a minimum radius of curvature approximation of the trajectory shape of said wellbore path and said augmenting said minimum radius of curvature approximation with said continuous inclination measurements being accomplished substantially simultaneously.

27. The method of claim 21, comprising:

said augmenting said minimum radius of curvature approximation being accomplished by minimizing the integral of the square of the curvature.

28. The method of claim 21, comprising:

said augmenting said minimum radius of curvature approximation being accomplished by adding to said minimum radius of curvature approximation the square of the difference between predicted and measured position.

29. The method of claim 21, wherein said augmenting said minimum radius of curvature approximation comprising:

(a) inverting a tridiagonal matrix of order N where N is the number of continuous inclination points between survey points: and (b) solving said tridiagonal matrix in order-N complexity.

30. The method of claim 21, comprising:

(a) generating a continuous inclination log;

(b) dividing the continuous inclination log into sections between each survey point;

(c) applying a gain and an offset to each section of the continuous inclination log forcing a match between the continuous inclination and survey point inclination at the endpoints of each section and confirming agreement there of;

(d) examining continuous inclination data to locate measured depths of the beginning and ending of each slide; and (e) augmenting surveys between survey points with said measured depths.

* * * * *